US008684788B2

(12) United States Patent
Cheung

(10) Patent No.: US 8,684,788 B2
(45) Date of Patent: Apr. 1, 2014

(54) THREE-DIMENSIONAL BRA UNDERWIRE

(75) Inventor: Suilung Cheung, Kaiping (CN)

(73) Assignee: Kaiping Hung Hon Garment Accessories Co., Ltd. (CN)

( * ) Notice: Subject to any disclaimer, the term of this patent is extended or adjusted under 35 U.S.C. 154(b) by 231 days.

(21) Appl. No.: 13/157,851

(22) Filed: Jun. 10, 2011

(65) Prior Publication Data

US 2012/0178341 A1 Jul. 12, 2012

(30) Foreign Application Priority Data

Jan. 11, 2011 (CN) ..... 2011 2 0006111 U

(51) Int. Cl.
*A41C 3/00* (2006.01)

(52) U.S. Cl.
USPC ..... 450/41; 450/45; 450/51

(58) Field of Classification Search
USPC ..... 450/41, 45, 51, 52, 47; 2/255–259, 262, 2/264, 260, 260.1, 261, 263
See application file for complete search history.

(56) References Cited

U.S. PATENT DOCUMENTS 3,605,753 A * 9/1971 Schwartz ..... 450/52
3,777,763 A * 12/1973 Schwartz ..... 450/52
5,141,470 A * 8/1992 Morgan et al. ..... 450/52
7,112,117 B2 * 9/2006 Horta et al. ..... 450/41

* cited by examiner

*Primary Examiner* — Gloria Hale
(74) *Attorney, Agent, or Firm* — Lerner, David, Littenberg, Krumholz & Mentlik, LLP

(57) ABSTRACT

The utility model relates to the field of women's underwear. The technical problem to be solved by the utility model is to overcome the shortcomings of the prior art and provide a three-dimensional bra underwire which is matched with the cup shape, has good supporting effects and is comfortable to use. The three-dimensional bra underwire comprises the middle part and two ends of the underwire, wherein the underwire is a inclined-type underwire with a certain inclination angle, at least one end of the underwire is a flat section, while the other parts are inclined section, and the inclined section is connected with the flat section by a transition section. In the utility model, the traditional flat underwire is changed into a three-dimensional underwire with a certain torsional stress so as to ensure that the underwire is matched with the cup shape well and has good supporting effects, bringing the shaping functions of the underwire into full play as well. Meanwhile, due to the better fit between the underwire and the human body, traces of the underwire can not be left on the body of the users, so that the three-dimensional bra underwire can improve the wearing comfort.

7 Claims, 2 Drawing Sheets

A-A

THREE-DIMENSIONAL BRA UNDERWIRE

BACKGROUND OF THE INVENTION

1. Technical Field

The utility model relates to the field of women's underwear, in particular to a three-dimensional bra underwire.

2. Description of Related Art

In order to get better body shape, the lower edge of the cup of the existing bra, shape wear and other women's underwear is lined with the semi-circular underwire. Most of the existing underwires are made by bending the banded metal strip into the semi-circular one. However, the planar underwire cannot be consistent with the hemispherical cup, so the exertion of the functions of the underwire is influenced, which means the underwire has bad supporting effects. What's more, traces of the underwire tend to be left on the body of the uses who wear the bra, influencing the comfort when wearing.

BRIEF SUMMARY OF THE INVENTION

The technical problem to be solved by the utility model is to overcome the shortcomings of the prior art and provide a three-dimensional bra underwire which is matched with the cup shape well, has good supporting effects and is comfortable to use.

In order to solve the aforementioned technical problem, the technical solution adopted by the utility model is as follows:

A three-dimensional bra underwire comprises the middle part and two ends of the underwire, wherein the middle part of the underwire is the inclined section with a certain inclination angle, while at least one end thereof is the flat section, and the inclined section is connected with the flat section by a transition section. The transition section has a twist angle which is continually changed from the joint with the flat section. The inclination angle is defined as the included angle between the horizontal and vertical surface of the underwire when used, which is the same with the definition of the twist angle. Due to the design of the inclined section and the transition section of which inclination angle is gradually changed, the shape of the underwire is matched with the human body curves well and the contact area between the underwire and the human body is larger so that the better supporting effects can be achieved and it is comfortable to wear and not easy for the traces of the underwire to be left on the human body. In addition, the inclination angle of the transition section which is gradually changed makes a smooth connection between the inclined and flat section, which means that there is no bulge in the underwire which is easy to make you fell uncomfortable; Meanwhile, due to the structure of smooth transition, it is difficult to produce stress concentration, which can greatly reduce the possibility of fracture at the connected position. In the utility model, with the transitional design from the inclined plane to the flat plane, the traditional flat underwire is changed into a three-dimensional underwire with a certain torsional stress so as to ensure that the underwire is matched with the cup shape well; The utility model has been formed integrally and is easy to be manufacture.

Preferably, two ends of the underwire are the flat sections. The symmetrical design of the underwire makes better structural performance. The underwire is not easy to be deformed.

The inclination angle of the inclined section can be 15 to 85 degrees. Based on the requirements of different users generally, the range of the inclination angle of the inclined section preferably is from 20 to 75 degrees. If the user's bust is small, the smaller inclination angle is more appropriate, that is, 30 to 40 degrees are generally taken; if the user's bust is big, the bigger inclination angle is more appropriate, that is, 60 to 75 degrees are generally taken.

For the size of most users, the inclination angle of the inclined section is preferably 38±4 or 26±6 degrees.

In order to ensure that the two ends of the underwire are difficult to prick the pocket at the lower edge of the cup so as to prolong the service life of the underwear and increase wearing comfort, the end of the underwire is matched with the protective paint layer, epoxy resin layer or polyurethane layer, or covered by nylon layer or thermoplastic elastomer.

In order to further enhance the structural safety of the underwire and increase using comfort, the end of the flat section can further be covered by at least one layer of thermoplastic sleeve made from polyethylene.

The wire constituting the three-dimensional bra underwire can be stainless steel, high carbon steel, titanium metal wire, resin plastics or polyester plastics.

Compared with the prior art, the beneficial effects of the technical solution of the utility model are as follows: due to the design of the inclined section and the transition section of which twist angle is gradually changed, the traditional flat underwire is changed into a three-dimensional underwire with a certain torsional stress so as to ensure that the underwire is matched with the cup shape and has good supporting effects, bringing the shaping functions of the underwire into full play. Meanwhile, due to the better fit between the underwire and the human body, traces of the underwire can not be left on the body of the users, improving the wearing comfort.

DETAILED DESCRIPTION OF THE INVENTION

The technical solution of the utility model will be further described below in conjunction with the attached drawings.

Embodiment 1

Figure 1:
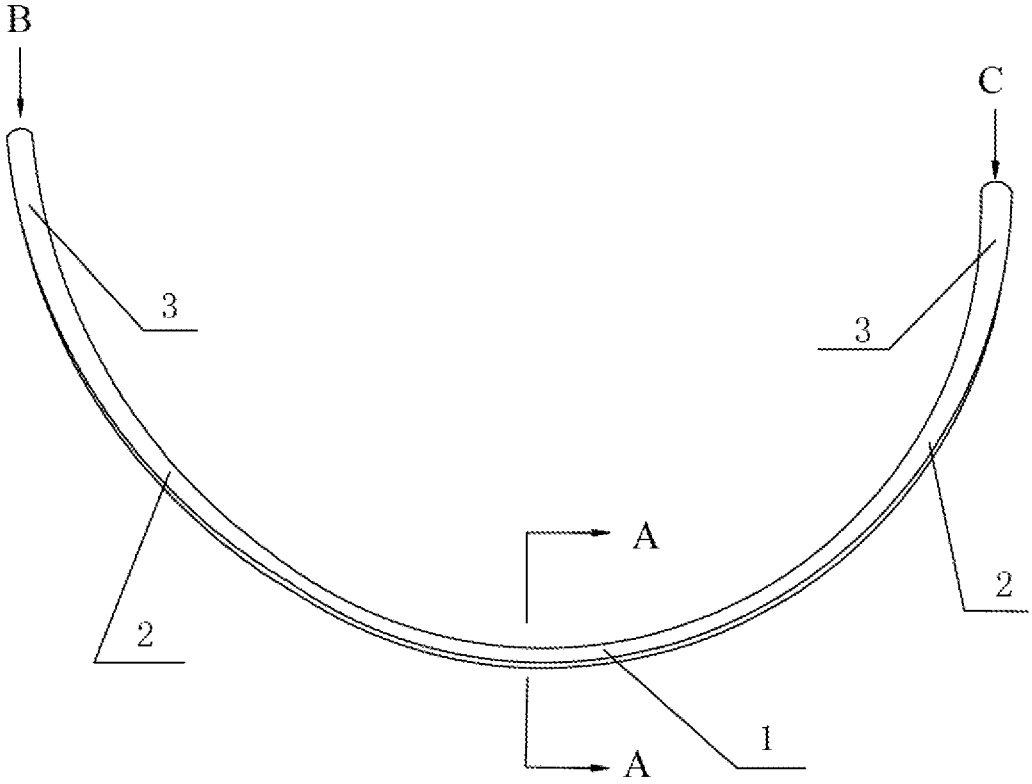
FIG. 1 is the structure schematic of embodiment 1.

The structure schematic of the three-dimensional bra underwire of the utility model is shown in FIG. 1, the underwire comprises an inclined section 1 with a certain inclination angle that is located in the middle part and a flat section 3 that is located at two ends of the inclined section 1, wherein the inclined section 1 is connected with the flat section 3 by a transition section 2. The twist angle of the transition section 2 is continually changed from the joint with the flat section 3 until it is the same with that of the inclined section 1. Through the design, the traditional flat underwire is changed into a three-dimensional underwire, which more fits the human body curves and has good supporting effects. Meanwhile, the traces of the underwire can not be left on the body of the users, so that the three-dimensional bra underwire can improve the wearing comfort.

Figure 2:
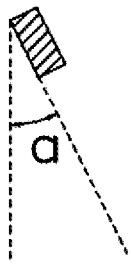
FIG. 2 is the sectional schematic view taken along the direction of A-A of FIG. 1.
Figure 3:
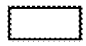
FIG. 3 is the end schematic view taken along the direction of B of FIG. 1.

The sectional schematic view taken along the direction of A-A of the utility model is shown in FIG. 2, the inclination angle of the inclined section 1 (namely, the included angle $\alpha$ between the inclined section 1 and the vertical plane) is 38 degree. The end schematic view taken along the direction of B of the utility model is shown in FIG. 3, the end is flat according to the FIG. 3. The sectional schematic view in the direction of C is the same with that in the direction of B.

Embodiment 2

Figure 4:
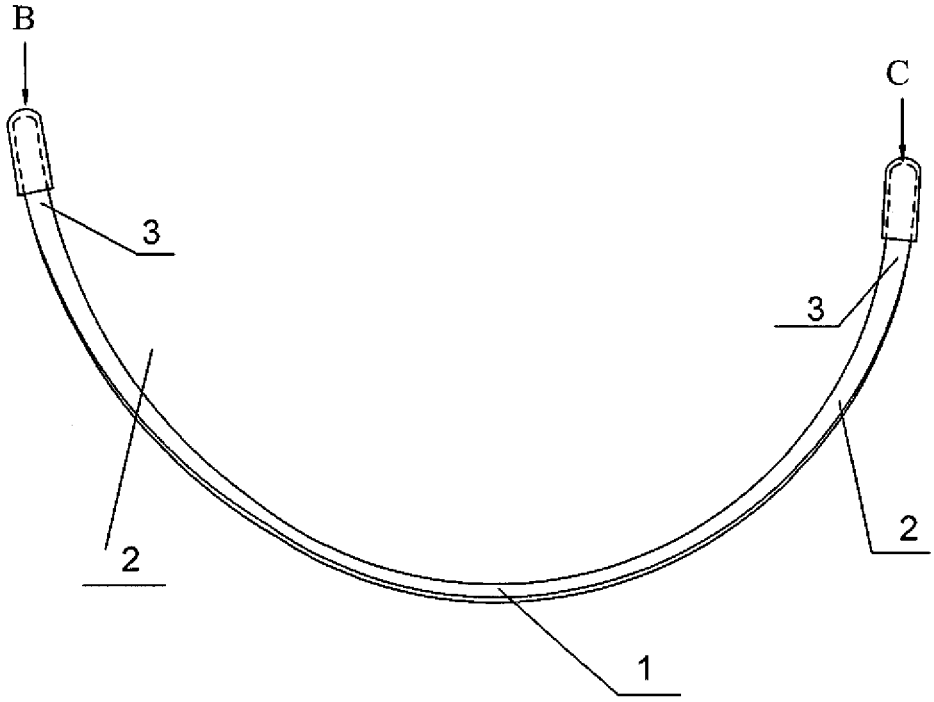
FIG. 4 is the structure schematic of embodiment 2.

FIG. 4 is another structure schematic of the three-dimensional bra underwire of the utility model, which is similar with embodiment 1. The difference between FIG. 4 and embodiment 1 lies in that the end of the flat section of the utility model is respectively equipped with a layer of thermoplastic sleeve made from polyethylene that can enhance the structural safety of the utility model and wearing comfort.

Embodiment 3

The embodiment has similar structure with the embodiment 1 and the difference only lies in that the inclination angle $\alpha$ of the inclined section is 55 degree.

Embodiment 4

The embodiment has similar structure with embodiment 1 and the difference only lies in that the inclination angle $\alpha$ of the inclined section is 65 degree.

Embodiment 5

The embodiment has similar structure with embodiment and the difference only lies in that one end of the utility model is the flat section, while the other end is the inclined section which has the same inclination angle with the middle part of the underwire and the inclination angle of the inclined section is 38 degree.

What is claimed is:

1. A three-dimensional bra underwire comprising an underwire having two end portions and a middle part therebetween, characterized in that said middle part of said underwire is inclined at an inclination angle of 15 to 85 degrees with respect to a vertical plane and the two end portions are both flat, wherein the middle part is connected with the two end portions by transition portions, each of the transition portions having a twist angle which is continually changed from joint points with the two end portions.

2. The three-dimensional bra underwire according to claim 1, characterized in that the inclination angle is 20 to 70 degrees.

3. The three-dimensional bra underwire according to claim 2, characterized in that the inclination angle is 38±4 or 26±6 degrees.

4. The three-dimensional bra underwire according to claim 2, characterized in that the inclination angle is 55±2 degrees.

5. The three-dimensional bra underwire according to claim 2, characterized in that the inclination angle is 65±2 degrees.

6. The three-dimensional bra underwire according to claim 1, characterized in that at least an end of the end portions is coated with protective paint layer, epoxy resin layer or polyurethane layer, or covered by nylon layer or thermoplastic elastomer.

7. The three-dimensional bra underwire according to claim 1, characterized in that at least an end of the end portions is covered by at least one layer of thermoplastic sleeve made from polyethylene and the underwire is made of stainless steel, high carbon steel, titanium metal wire, resin plastics or polyester plastics.

* * * * *